United States Patent [19]

Yamamoto et al.

[11] Patent Number: 4,754,249

[45] Date of Patent: Jun. 28, 1988

[54] CURRENT LEAD STRUCTURE FOR SUPERCONDUCTING ELECTRICAL APPARATUS

[75] Inventors: Yuichi Yamamoto; Takashi Sato, both of Kobe, Japan

[73] Assignee: Mitsubishi Denki Kabushiki Kaisha, Tokyo, Japan

[21] Appl. No.: 49,175

[22] Filed: May 13, 1987

[30] Foreign Application Priority Data

May 13, 1986 [JP] Japan ..... 61-107577

[51] Int. Cl.[4] ..... H01F 7/22

[52] U.S. Cl. ..... 335/216; 62/514 R; 174/15 CA

[58] Field of Search ..... 335/216; 174/15 CA, 174/15 S, 15 HP; 62/514 R

[56] References Cited

U.S. PATENT DOCUMENTS 3,349,161 10/1967 Latham ..... 174/15 CA
4,187,387 2/1980 Parmer ..... 174/15 CA
4,369,636 1/1983 Purcell et al. ..... 174/15 CA
4,558,512 12/1985 Chaussy et al. ..... 174/15 CA
4,625,192 11/1986 Kawaguchi ..... 335/216
4,625,193 11/1986 Purcell ..... 335/216

*Primary Examiner*—George Harris
*Attorney, Agent, or Firm*—Sughrue, Mion, Zinn, Macpeak & Seas

[57] ABSTRACT

An insulated pipe 6 has an open lower end extending into a cryostat 1 and a closed upper end in communication with the atmosphere through a vacuum chamber 3 surrounding the cryostat. A conductor 8*a* is disposed within the pipe and connected at its opposite ends between an external terminal 7*a* extending through the top of the pipe and an internal terminal 9 associated with an electrical apparatus mounted within the cryostat. An outlet 10 is provided in the top of the pipe to exhaust gaseous helium from the cryostat. The conductor is configured as a spiralling coil to minimize its axial length while maximizing its overall length to thereby enhance its cooling by the exhausting helium gas, and may be structurally supported by a core 12 disposed concentrically within the pipe.

5 Claims, 2 Drawing Sheets

CURRENT LEAD STRUCTURE FOR SUPERCONDUCTING ELECTRICAL APPARATUS

BACKGROUND OF THE INVENTION

This invention relates to a current lead structure for a superconducting electrical apparatus disposed in a cryostat, and particularly to such a structure for connecting the apparatus to an external circuit in the atmosphere at normal temperature.

FIG. 1 shows a conventional current lead structure L associated with a cryostat 1 containing liquid helium 2 and a superconducting electrical apparatus (not shown), similar to that described in Japanese kokai No. 60-173883 published Sept. 7, 1985. The cryostat is disposed in a chamber 3 having a vacuum space 11 to adiabatically isolate it from the external atmosphere. A metal pipe 6 having thermal and electrical insulating material 5 applied to its inner surface has an open lower end inserted in and mounted to a wall 1*a* of the cryostat, and an upper end closed by a cap 7 projecting outwardly from and fixed to the vacuum chamber 3. A connecting terminal 7*a* extends through the cap. An elongate conductor 8 is disposed in the insulated pipe 6 and is connected between the terminal 7*a* and a conductor 9 coupled to the superconducting electrical apparatus. An outlet 10 is attached to the upper end of the pipe 5 to vent or exhaust the vaporized cooling medium, i.e. helium gas. Such gas may be simply vented to the atmosphere, but more typically it would forcibly be withdrawn, i.e. pumped out, reliquefied, and returned to the cryostat in a closed cycle recirculation system.

In such a conventional current lead structure, the superconducting electrical apparatus, such as an induction coil, is cooled by its immersion in the liquid helium 2 within the cryostat to a temperature below 4.2° K., and the vacuum space 11 between the cryostat and the chamber 3 reduces the heat loss to the atmosphere. Moreover, the exhaust of the vaporized but still very cold helium gas from the space 4 within the cryostat, up through the pipe 5 and out through the outlet 10, serves to carry away much of the Joule or $I^2R$ heat generated in the conductor 8 by the high amplitude current flowing therethrough.

Conflicting considerations arise with such a construction, however. On the one hand, it is desirable that the conductor 8 be as long as possible to maximize its cooling by the exhausting helium gas and attendantly minimize the heat loss to the atmosphere. On the other hand, it is desirable that the conductor 8 be as short as possible to reduce the overall size of the apparatus.

SUMMARY OF THE INVENTION

The present invention resolves these conflicting considerations by providing a current lead structure for a superconducting electrical apparatus wherein the input/output conductor(s) is configured as a spiral such that its overall or effective length for cooling purposes is maximized while at the same time its axial length is minimized to enable the desired apparatus size reduction.

DETAILED DESCRIPTION OF THE PREFERRED EMBODIMENTS

Figure 1:
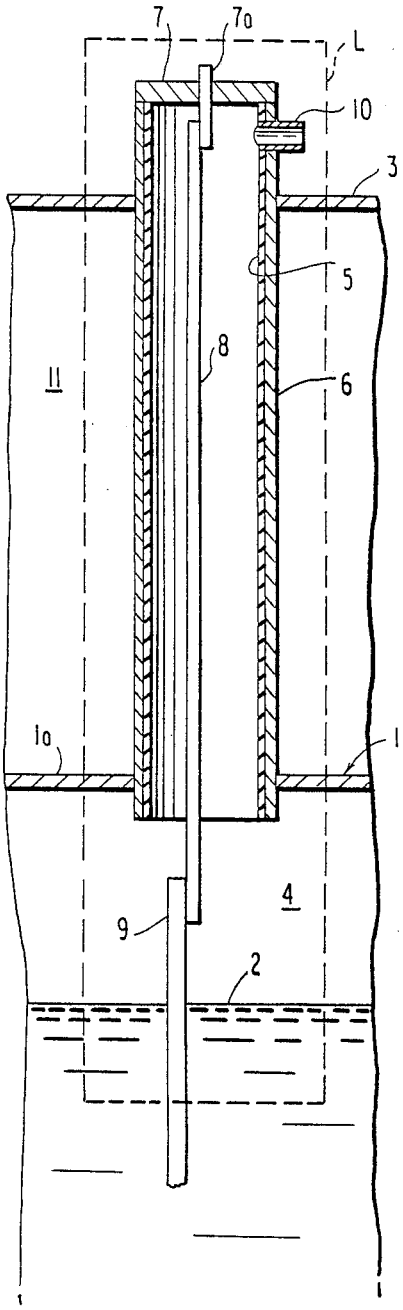
FIG. 1 PRIOR ART
FIG. 1 is a sectional view of a conventional current lead structure for a cryostat.
Figure 2:
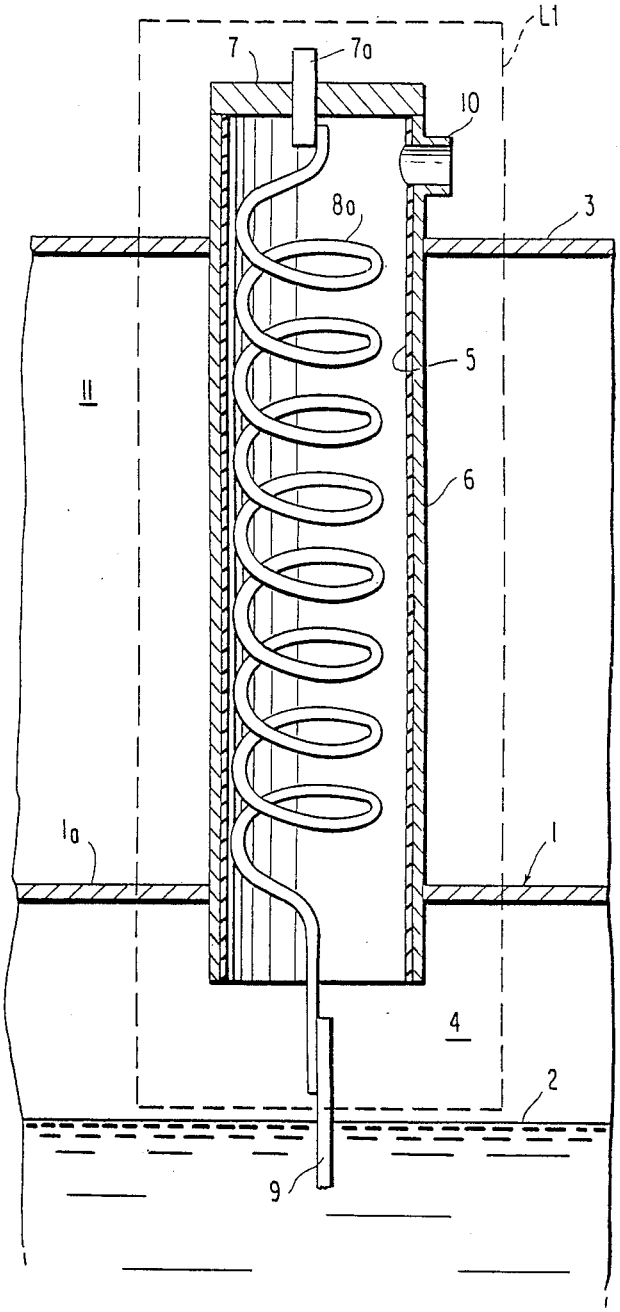
FIG. 2 is a sectional view of a current lead structure in accordance with one embodiment of the present invention.

Referring to FIG. 2, wherein the same reference numerals used in connection with FIG. 1 designate like components, a current lead structure L1 provided by this invention includes a spirally configured conductor 8*a* disposed within the pipe 6 and wound from a single wire. Such a configuration greatly increases the overall length of the conductor and thus the length of the heat conduction path defined thereby, while at the same time correspondingly increasing its overall surface area to thus enhance the cooling of the conductor by the exhausting helium gas. At the same time, of course, the spiral configuration of the conductor 8 enables its axial length to be reduced as necessary to accommodate design size criteria for the overall apparatus.

Although the spiral conductor 8*a* is made of a solid wire in the embodiment mentioned above, it can also be made of retiform wire or a twisted cable, and/or heat dissipating fins can be provided on the surface of the conductor to enhance its cooling by the helium gas.

Figure 3:
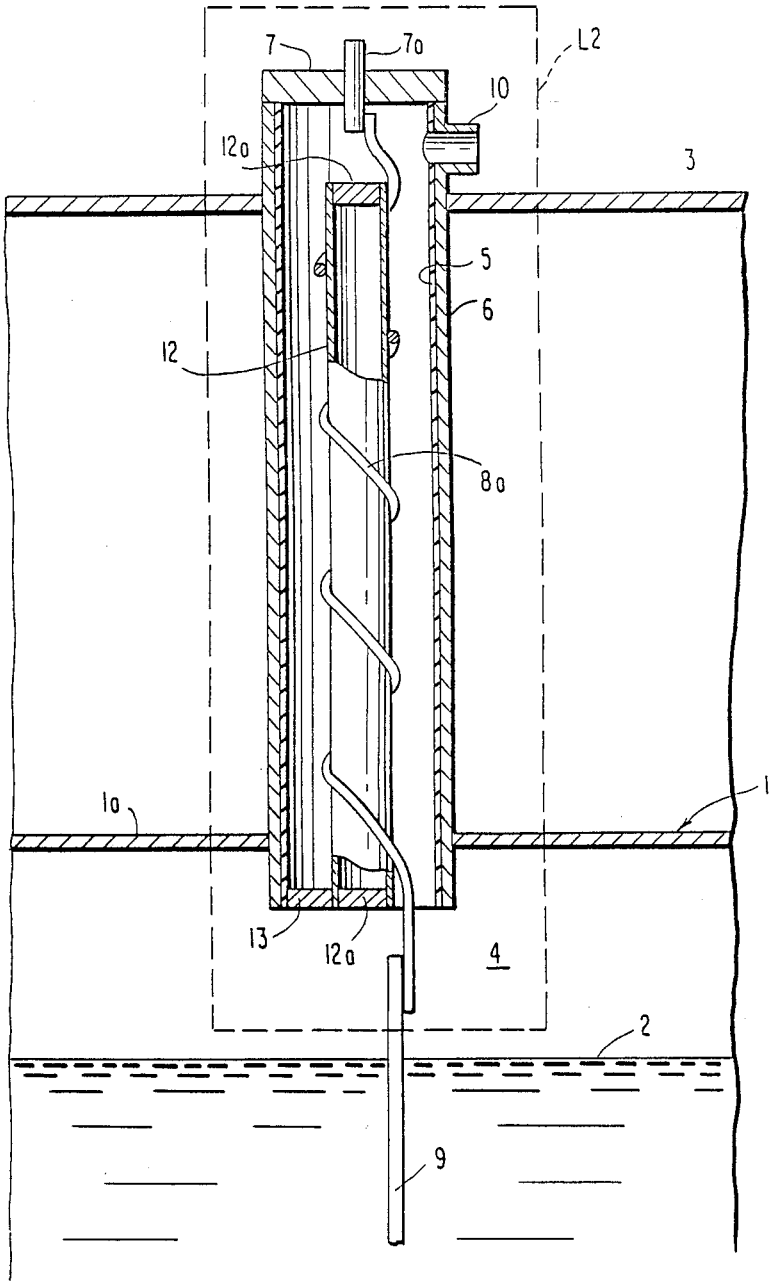
FIG. 3 is a sectional view of a current lead structure in accordance with another embodiment of the invention.

In the embodiment of FIG. 3 a cylindrical core 12 is concentrically mounted within the insulated pipe 6 by a radial support member(s) 13 at its lower end, and the conductor 8*a* is wound around such core in a spiral manner as before. The core 12 is constructed as a pipe having both ends closed by stoppers 12*a*, and is made from a material having a low coefficient of thermal conductivity. The spiral conductor 8*a* is cooled by the exhausting helium gas as described above, and the presence of the core 12 affords additional structural support for the conductor to prevent its deformation. Since the core 12 is made from a poor heat conductive material and is only supported at its lower end inside the cryostat 1 and thus out of contact with the upper, higher temperature portion of the pipe 6 exposed to the atmosphere, it does not provide any appreciable heat conduction path.

Although the core 12 is configured as a pipe in FIG. 3, it can also be made of a solid rod having a low heat transfer coefficient.

What is claimed is:

1. A current lead structure for a superconducting electrical apparatus disposed in a cryostat (1), comprising:

(a) an electrically and thermally insulated pipe (6) having an open lower end inserted through a wall (1*a*) of the cryostat and extending thereinto in continuous communication with a gaseous phase of a liquefied coolant (2), and a closed upper end portion in communication with the atmosphere, (b) a conductor (8*a*) disposed within the pipe and spaced from an interior surface thereof, the conductor being connected at opposite ends thereof between a terminal (9) of the electrical apparatus disposed within the cryostat and an external terminal (7*a*) extending through the upper end portion of the pipe, said conductor being continuously surrounded by the gaseous phase of the liquid coolant, and generating $I^2R$ heat during the operation of the electrical apparatus due to the resistance thereof to the passage of current, and (c) an outlet aperture (10) in the upper end portion of the pipe for exhausting the gaseous phase coolant, (d) the conductor being configured as a spiralling coil to increase its overall length and thus its surface area and thereby enhance its cooling by the exhausting gaseous phase coolant to dissipate said heat generated in the conductor by electrical currant flowing therethrough, while concurrently maintaining a desired axial length to avoid any increase in the size of the lead structure.

2. A current lead structure according to claim 1, further comprising an elongate cylindrical core (12) made of a material having a low coefficient of thermal conductivity disposed concentrically within the pipe and spaced from the upper end portion thereof, wherein the spiralled coil conductor is wound around said core and supported thereby to prevent the deformation of the conductor.

3. A current lead structure according to claim 2, wherein the core comprises a hollow pipe closed (12*a*) at opposite ends thereof, and is mounted to the insulated pipe only at the lower end thereof within the cryostat via a radial support member (13).

4. A current lead structure according to claim 1, further comprising a vacuum chamber (3) surrounding and spaced from the cryostat to define an adiabatic enclosure, and wherein the upper end portion of the insulated pipe extends outwardly through said chamber to communicate with the atmosphere.

5. A current lead structure according to claim 3, further comprising a vacuum chamber (3) surrounding and spaced from the cryostat to define an adiabatic enclosure, and wherein the upper end portion of the insulated pipe extends outwardly through said chamber to communicate with the atmosphere.

* * * * *